US006357137B1

(12) United States Patent
Childs et al.

(10) Patent No.: US 6,357,137 B1
(45) Date of Patent: Mar. 19, 2002

(54) NON-WOVEN FABRIC FOR IMPARTING FABRIC TREATMENT TO CLOTHING

(75) Inventors: Stephen Lee Childs, Cincinnati; Anthony James Burns, West Chester; Alessandro Corona, III, Maineville, all of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/494,800

(22) Filed: Jan. 31, 2000

Related U.S. Application Data

(60) Provisional application No. 60/120,117, filed on Feb. 16, 1999, and provisional application No. 60/134,968, filed on May 20, 1999.

(51) Int. Cl.[7] ..... F26B 19/00; C11D 1/83

(52) U.S. Cl. ..... 34/63; 34/61; 34/597; 510/516; 510/520

(58) Field of Search ..... 34/61, 63, 595, 34/597, 618; 510/516, 520, 521, 504, 499, 491

(56) References Cited

U.S. PATENT DOCUMENTS 4,076,633 A * 2/1978 Edwards et al. ..... 252/8.75
4,216,772 A 8/1980 Tsuchiya et al.
4,818,422 A * 4/1989 Adams et al. ..... 252/8.8
5,283,106 A 2/1994 Seiler et al.
5,470,492 A 11/1995 Childs et al.
5,752,945 A 5/1998 Mosley et al.
5,804,547 A 9/1998 Godfroid et al.
5,820,645 A 10/1998 Murphy, Jr.
5,883,069 A * 3/1999 Childs et al. ..... 252/8.6
5,929,026 A * 7/1999 Childs et al. ..... 510/520
5,968,855 A 10/1999 Perdelwitz, Jr. et al.
6,107,270 A * 8/2000 Smith et al. ..... 510/516
6,133,226 A * 10/2000 Knowlton et al. ..... 210/520
6,169,067 B1 * 1/2001 Childs et al. ..... 510/520

FOREIGN PATENT DOCUMENTS

WO WO 00/15891 3/2000

* cited by examiner

*Primary Examiner*—Pamela Wilson
(74) *Attorney, Agent, or Firm*—Frank C. Turner; Kim William Zerby; Steven W. Miller

(57) ABSTRACT

Non-woven fabrics prepared from fibers having two different deniers useful as substrates in the preparation of dryer-activated fabric conditioning articles. By combining lower denier fibers with higher denier fibers, a substrate is produced that has the tensile strength similar to that of the lower denier substrate combined with the thickness and coating capacity similar to that of the higher denier substrate. Articles comprising said substrates contain: (A) at least about 5% fabric conditioning composition comprising fabric conditioning active; and (B) said substrate.

20 Claims, No Drawings

NON-WOVEN FABRIC FOR IMPARTING FABRIC TREATMENT TO CLOTHING

CROSS-REFERENCE TO RELATED APPLICATIONS

This application claims the benefit under 35 USC §119(e) of the U.S. provisional application of Stephen Lee Childs, Anthony James Burns and Alessandro (nmn) Corona, III having Ser. No. 60/120,117, filed Feb. 16, 1999; and the U.S. provisional application of Stephen Lee Childs, Anthony James Burns and Alessandro (nmn) Corona, III having Ser. No. 60/134,968, filed May 20, 1999.

TECHNICAL FIELD

The present invention relates to an improvement in dryer activated, e.g., dryer-added, fabric treatment (conditioning) products (articles). These products are prepared by attaching conditioning compositions to a substrate, especially a non-woven fabric, e.g., spun bonded polyester, substrate.

SUMMARY OF THE INVENTION

The present invention relates to dryer-activated fabric treatment/conditioning articles comprising improved non-woven, e.g., spun bonded polyester substrates for use in an automatic clothes dryer and to the said substrates. These articles comprise:

(A) at least about 5%, preferably from about 10% to about 95%, more preferably from about 40% to about 90%, and even more preferably from about 50% to about 85%, of fabric treatment/conditioning composition comprising fabric treatment/conditioning active and (B) a non-woven fabric, preferably polyester and/or nylon, more preferably polyester, substrate prepared from fibers having at least two different deniers that differ in denier by at least about 2, preferably by at least about 4, the fiber deniers being from about 2, preferably from about 4 to about 16 with at least one fiber having a denier equal to, or below, about 8, preferably below about 6, and at least one other fiber having a denier of at least about 8, preferably at least about 10, said fibers preferably being bonded, e.g., by melting or adhesive, to provide increased strength, said substrate having a basis weight of from about 0.35 oz/yd$^2$ to about 0.75 oz/yd$^2$, preferably from about 0.45 oz/yd$^2$ to about 0.65 oz/yd$^2$, more preferably from about 0.50 oz/yd$^2$ to about 0.64 oz/yd$^2$, and a thickness of from about 0.16 mm to about 0.38 mm, preferably from about 0.20 mm to about 0.35 mm, more preferably from about 0.21 mm to about 0.30 mm, and preferably a modulus of elasticity in the machine direction and cross direction as described hereinafter, of from about 1.5 to 5.5, preferably from about 2.0 to 5.0 more preferably from about 2.0 to 4.5 in the machine direction, and 1.5 to 3.5 in the cross direction, preferably a tensile strength of at least about 3 lbs/in$^2$ in both the cross direction and the machine direction, preferably from about 3.5 to about 7.0 lbs/in$^2$ in the cross direction and from about 5.0 to about 10 lbs/in$^2$ in the machine direction, said polyester and/or nylon having the ability to hold more fabric conditioning composition as compared to conventional substrates of this type.

Substrates of lower denier, for example 6 denier or below, tend to have a higher tensile strength but lower thickness and coating capacity. Substrates of a higher denier, for example 10 denier or higher, tend to have a greater thickness and coating capacity but do not have the tensile strength required for processing. By combining the lower denier fibers with the higher denier fibers, a substrate is produced that has the tensile strength of the lower denier combined with the thickness and coating capacity of the higher denier substrate.

The amount of (A) present is at least sufficient to provide a modification in, preferably improved, fabric characteristics.

DETAILED DESCRIPTION OF THE INVENTION

The present invention relates to improved substrates for dryer-added fabric treatment/conditioning and to articles comprising said substrates with improved ability to hold, e.g., fabric treatment/conditioner composition for use in an automatic clothes dryer. This improved ability to hold fabric conditioner compositions is defined as coating capacity and is equal to the grams of conditioner per unit area of substrate. It has been found that substrates prepared from fiber having a denier of 8 or more, can be formed that have increased coating capacity due to increased substrate thickness when compared with substrate made from small denier fibers at the same fabric basis weight. However, as the denier of the fiber is increased, the strength of the fabric is compromised as less fibers are available at the same fabric basis weight. It has now been found that preparing the substrate by, e.g., layering for example a 4 or a 6 denier fiber on the outside of at least one side of a substrate made of a higher denier fiber delivers acceptable strength characteristics. Thus, one can achieve the coating capacity of the higher denier fiber while maintaining the strength of the lower denier fiber.

For example, forming a substrate by laying down a continuous 12 denier fiber, at the same basis weight as a common 4 denier fiber provides a substrate with an increased thickness of about 27% and consequently a higher coating capacity. This thickness combined with the layering on the surface of a 4 denier fiber provides an increased coating capacity of about 30% while delivering a significant improvement in fabric strength over a fabric with the same basis weight made from 12 denier fiber only. The fibers can also be laid down to intermingle by using, e.g., weaving techniques; entangling fibers, etc.

The improved articles herein comprise:

(A) at least about 5%, preferably from about 10% to about 95%, more preferably from about 40% to about 90%, and even more preferably from about 50% to about 85%, of fabric conditioning composition comprising fabric conditioning active; and (B) non-woven, preferably a polyester or nylon, more preferably polyester, fabric substrate prepared from fibers having at least two different deniers that differ in denier by at least about 2, preferably by at least about 4, the fiber deniers being from about 2, preferably from about 4 to about 16 with at least one fiber having a denier equal to, or below, about 8, preferably below about 6, and at least one other fiber having a denier of at least about 8, preferably at least about 10, said substrate having a basis weight of from about 0.35 oz/yd$^2$ to about 0.75 oz/yd$^2$, preferably from about 0.45 oz/yd$^2$ to about 0.65 oz/yd$^2$, more preferably from about 0.50 oz/yd$^2$ to about 0.64 oz/yd$^2$, and a thickness of from about 0.16 mm to about 0.38 mm, preferably from about 0.2 mm to about 0.35 mm, more preferably from about 0.21 mm to about 0.3 mm, and a modulus of elasticity in the machine direction and cross direction as described hereinafter, of from about 1.5 to 5.5, preferably from about 2.0 to 5.0 more preferably from about 2.0 to 4.5 in the machine direction and 1.5 to 3.5 in the cross direction, preferably a tensile strength of at least about 3 lbs/in$^2$ in both the cross direction and the machine direction, preferably from about 3.5 to about 7.0 lbs/in$^2$ in the cross direction and from about 5 to about 10 lbs/in$^2$ in the machine direction, said polyester and/or nylon having the ability to hold more fabric conditioning composition as compared to conventional substrates of this type. Furthermore, the multi-denier fabric is significantly stronger than the large single denier substrate at the same basis weight.

The fabrics are typically prepared as spun-bonded fabrics by laying thin layer(s) of fiber(s) in a random pattern on a moving foraminous belt and then applying heat to melt at least a portion of the surfaces of the fibers and applying heat and pressure to fuse the adjacent fibers to each other at their intersections. The amount of heat and pressure is adjusted to provide the desired bonding. When making the multi-denier substrate, the filaments, each of which typically forms one layer, are preferably applied to the foraminous belt in separate stages such as 25% by weight of 6 denier fiber followed by 25% by weight of 12 denier fiber, 25% by weight of 12 denier fiber, and finally 25% by weight of 6 denier fiber, creating a "sandwich" of 6/12/12/6 denier fibers as the substrate. The percentage of various deniers as well as the order of application of the deniers may be changed to produce variations in substrate physical properties such as substrate thickness and strength. Different flexibility characteristics can be achieved by using different denier fibers. An interior layer of a higher denier usually results in a stiffer substrate and an interior layer of a smaller denier fiber normally results in a more flexible substrate. In all instances, the preferred denier fiber on one, or preferably both, outside layers, is a lower denier for better, preferably improved, fabric feel.In general, each layer formed by using a different denier fiber preferably has about the same basis weight for each unit area, but each layer can be formed with different basis weights, e.g., by using the same length of fiber, or any variation, the fiber in each layer is usually applied in a different part of the process in sequential stages starting from the bottom and working up to the top.

Similar substrate property benefits using the multi-denier fiber approach can be achieved using carded staple fibers made of, e.g. rayon and polyester, alone or in combination with filament fibers.

A typical process for bonding the fibers in the web is know as area bonding. Other means of bonding multi-denier fibers to obtain the similar improvements in substrate properties include, but are not limited to, point bonding, hydroentanglement, and/or chemical binding.

Usage

The articles of this invention can be used for imparting the fabric treatment composition to fabric (clothes) to provide, but not limited to, softening and/or antistatic effects to fabric in an automatic laundry dryer. Generally, the method of using the articles of the present invention comprises: commingling pieces of damp fabric by tumbling said fabric under heat in an automatic clothes dryer with an article comprising an effective amount of composition (A). The fabric treatment composition preferably should have a melting point greater than about 35° C. and be flowable at dryer operating temperature. However, any type of material can be included in the substrate and applied to the fabric so long as it can be retained and distributed to fabrics in the dryer. Suitable fabric treatment/conditioning compositions are disclosed in U.S. Pat. No. 5,234,610, issued Aug. 10, 1993, entitled "Treatment of fabric with perfume/cyclodextrin complexes", by Gardlik, John M.; Trinh, Toan; and Banks, Todd J. and related U.S. Pat. Nos. 5,094,761 and 5,102,564; U.S. Pat. No. 4,818,569, issued Apr. 4, 1989, entitled "Articles and methods for treating fabrics in clothes dryer", by Trinh, Toan; Gosselink, Eugene P.; and Rattinger, Gail B. and related U.S. Pat. No. 4,764,289; U.S. Pat. No. 5,681,806, issued Oct. 28, 1997, entitled "Dryer-activated fabric conditioning compositions containing uncomplexed cyclodextrin", by Trinh, Toan and Tordil, Helen Bernardo and related U.S. Pat. Nos. 5,775,408 and 5,783,552; U.S. Pat. No. 5,384,186, issued Jan. 24, 1995, entitled "Non-destructive carriers for cyclodextrin complexes", by Trinh, Toan and related U.S. Pat. Nos. 5,139,687; 5,246,611; and 5,139,687; U.S. Pat. No. 5,476,599, issued Dec. 19, 1995, entitled "Dryer-activated fabric conditioning and antistatic compositions containing biodegradable compounds having unsaturation", by Rusche, John R.; Hartman, Frederick A.; Sivik, Mark R.; Bacon, Dennis R.; and Trinh, Toan; U.S. Pat. No. 5,474,691, issued Dec. 12, 1995, entitled "Dryer-added fabric treatment article of manufacture containing antioxidant and sunscreen compounds for sun fade protection of fabrics", by Severns, John C., and related U.S. Pat. No. 5,733,855; U.S. Pat. No. 5,578,234, issued Nov. 26, 1996, entitled "Dryer-activated fabric conditioning compositions containing unsaturated fatty acid", by Corona, III, Alessandro; Palmer, Clyde D., and Rusche, John R.; U.S. Pat. No. 5,376,287, issued Dec. 27, 1994, entitled "Dryer-activated fabric conditioning compositions containing ethoxylated/propoxylated sugar derivatives", by Borcher, Sr., Thomas A.; Corona, III, Alessandro; Sturdivant, Willis A.; Sung, Stephanie L.; and Wojcik, David M.; U.S. Pat. No. 4,000,340, issued Dec. 28, 1976, entitled "Clothes dryer additive containing crisping agents", by Murphy, Alan Pearce; and Habermehl, III, Fred Martin; U.S. Pat. No. 5,559,088, issued Sep. 24, 1996, entitled "Dryer-activated fabric conditioning and antistatic compositions with improved perfume longevity", by Severns, John C.; Sivik, Mark R.; Hartman, Frederick A.; Denutte, Hugo R. G.; Costa, Jill B.; and Chung, Alex H. and related U.S. Pat. No. 5,830,835; U.S. Pat. No. 5,716,918, issued Feb. 10, 1998, entitled "Sulfonate perfinnes for dryer-activated fabric conditioning and antistatic compositions", by Sivik, Mark Robert and Hartman, Frederick Anthony; U.S. Pat. No. 5,562,847, issued Oct. 8, 1996, entitled "Dryer-activated fabric conditioning and antistatic compositions with improved perfume longevity", by Waite, Scott W.; Severns, John C.; and Sivik, Mark R.; all of said patents being incorporated herein by reference.

The present invention primarily relates to an improved non-woven fabric that is particularly desirable for use as a substrate for improved dryer-activated fabric conditioner articles that have improved acceptability to the consumer.

All percentages, ratios, and parts herein, in the Specification, Examples, and Claims, are by weight and are approximations unless otherwise stated. All references referred to herein are incorporated by reference.

The following are nonlimiting examples of the instant articles, methods, and compositions of the present invention.

EXAMPLE 1

| Components | Wt. % |
|---|---|
| Ditallowdimethylammonium methylsulfate | 21.04 |
| Stearyldimethylamine Stearic Acid Salt* | 32.83 |
| Perfume/Cyclodextrin Complex | 19.36 |
| Clay** | 3.79 |
| Perfume | 1.56 |
| Sodium $C_{12}$ Alkylbenzene Sulfonate | 0.38 |
| Sorbitan Monostearate | 21.04 |
| | 100.0 |

*1:2 ratio of stearyldimethylamine:triple-pressed stearic acid.
**Calcium bentonite clay, Bentolite L, sold by Southern Clay Products, or Gelwhite GP clay.

PREPARATION OF THE SUBSTRATE

The substrate is prepared in a conventional manner with the changes being in the bonding temperature (from about 237° C. to about 230° C.) and the consolidating pressures (from about 40 psig to about 0 psig for the nip roll and from about 10 psig to about 4.5 psig for the consolidation roll steam pressure) and denier from 4 dpf to 12 dpf. When making the multi-denier substrate, the total number of filaments to be applied to the foraminous belt are applied in various stages such as 25% 6 denier followed by 25% 12 denier, 25% 12 denier, and finally 25% 6 denier creating a sandwich of 6/12/12/6 denier substrate. The percentage of various deniers as well as the order of application of the deniers can be changed to produce variations in substrate physical properties such as substrate thickness or sheet feel.

| Type | Units | A | B | C | D | E | F |
|---|---|---|---|---|---|---|---|
| Denier | gms/9000 meter | 6 | 12 | 12 | 6/12/12/6 | 6/12/12/6 | 4/12/12/4 |
| Basis Weight | oz/yard$^2$ | 0.53 | 0.54 | 0.56 | 0.52 | 0.58 | 0.56 |
| Coating Capacity | gms/inches$^2$ | 0.032 | 0.040 | 0.040 | 0.046 | 0.050 | 0.046 (estimate) |
| Thickness | inches | 0.0073 | 0.0099 | 0.0100 | 0.0086 | 0.0092 | 0.0086 |
| Tensile Strength Cross Direction | pounds per linear inch | 6.2 | 3.6 | 3.4 | 4.2 | 5.8 | 5.0 |
| Tensile Strength Machine Direction | pounds per linear inch | 9.0 | 5.5 | 5.7 | 6.7 | 8.5 | 7.5 |
| Modulus Cross Direction | n/a | 2.6 | 1.5 | 1.5 | 2.2 | 3.0 | 2.1 |
| Modulus Machine Direction | n/a | 3.9 | 3.0 | 3.3 | 3.7 | 4.2 | 3.7 |

PREPARATION OF FABRIC CONDITIONING SHEETS

The coating mixture is applied to the said improved substrate sheets (22.86 cm. by 22.86 cm., about 523 sq. cm., having a substrate weight of about 1 gm). The substrate sheets are comprised of about 6 and about 12 denier spun bonded polyester in the 6:12:12:6 sandwich or of about 4 and about 12 denier spun bonded polyester in the 4:12:12:4 sandwich described above. The molten fabric conditioning composition is applied with an impregnation head to the surface of the substrate and the impregnated sheet is drawn between two heated rollers to impregnate the substrate and remove excess conditioning composition. The composition is applied in an amount of about 2.4 to 4.1 grams per sheet.

What is claimed is:

1. Non-woven fabric prepared from at least two different fibers having deniers of from about 2 to about 16, with the smaller and larger denier fibers having a difference in denier of at least about 2, said substrate having a basis weight of from about 0.5 oz/yd$^2$ to about 0.64 oz/yd$^2$, a thickness of from about 0.16 mm to about 0.38 mm, to provide a fabric having improved void volume without reduced strength.

2. The non-woven fabric of claim 1 wherein the two different fibers have deniers of from about 4 to about 16.

3. The non-woven fabric of claim 1 wherein said fibers are selected from the group consisting of: nylon, polyester, and mixtures thereof.

4. The non-woven fabric of claim 3 wherein said fabric is spun-bonded.

5. The non-woven fabric of claim 4 wherein said fibers are polyester.

6. The non-woven fabric of claim 3 wherein said fibers are nylon and said fabric is point bonded.

7. The non-woven fabric of claim 1 wherein said smaller fibers are in at least one layer on the outside of a layer formed by said larger fibers.

8. A dryer-activated fabric conditioning article comprising:

(a) at least about 5% of fabric conditioning composition comprising fabric conditioning active; and (b) a substrate comprising the non-woven fabric of claim 1.

9. The dryer-activated fabric conditioning article of claim 8 wherein said non-woven fabric comprises polyester fibers.

10. The article of claim 9 wherein said fibers have deniers that differ by at least about 4 denier.

11. The article of claim 10 wherein said fibers have deniers of about 6 and about 12.

12. The article of claim 11 wherein said article comprises from about 50% to about 80% of said fabric conditioning composition.

13. The article of claim 12 wherein said substrate has a thickness of from about 0.2 mm to about 0.35 mm and a tensile strength of at least about 3 lbs/in$^2$ in both the cross direction and the machine direction.

14. A dryer-activated fabric conditioning article comprising:

(a) from about 50% to about 85% of fabric conditioning composition comprising fabric conditioning active; and (b) a polyester non-woven fabric substrate prepared from two different polyester fibers having deniers of from about 4 to about 8 and from about 8 to about 16 respectively, the difference in deniers being at least about 4 and both outside surfaces being formed from the lower denier fiber, said substrate having a basis weight of from about 0.5 oz/yd$^2$ to about 0.64 oz/yd$^2$, a thickness of from about 0.21 mm to about 0.3 mm and a tensile strength of at least about 3.5 to about 7 lbs/in$^2$ in the cross direction and from about 5 to about 10 lbs/in$^2$ in the machine direction and said substrate having improved void volume, while maintaining essentially the tensile strength of the lesser denier substrate.

15. The article of claim 14 wherein said polyester non-woven fabric substrate is prepared from fibers, at least one having a denier of 3 to about 7, and at least one having a denier of from about 10 to about 13.

16. The process of using the article of claim 8 in an automatic laundry dryer to condition fabrics.

17. The process of using the article of claim 14 in an automatic laundry dryer to condition fabrics.

18. A non-woven fabric substrate having superior properties for use in preparing an article for conditioning fabrics in an automatic clothes dryer, said substrate being prepared from at least two different fibers selected from the group consisting of polyester fibers, nylon fibers, and mixtures thereof, said fibers having deniers of from 2 to about 16, with the fibers comprising at least two fibers with smaller and larger deniers said fibers having a difference in denier of at least about 2, and said substrate having a basis weight of from about 0.50 oz/yd$^2$ to about 0.64 oz/yd$^2$, a thickness of from about 0.21 mm to about 0.30 mm, to provide a substrate having improved void volume and essentially equivalent strength as compared to a similar substrate prepared from the smaller denier fiber.

19. The substrate of claim 18 wherein the smaller denier fiber is in at least one layer on the outside of said substrate.

20. The substrate of claim 19 wherein said substrate is formed from polyester fibers.

* * * * *